US006475428B1

(12) United States Patent
Fraval et al.

(10) Patent No.: US 6,475,428 B1
(45) Date of Patent: Nov. 5, 2002

(54) METHOD OF PRODUCING TITANIUM POWDER

(76) Inventors: Joseph T. Fraval, 43 Spur Cir., Scottsdale, AZ (US) 85251; Mitchell T. Godfrey, 230 N. Fock Ray Creek, Townsend, MT (US) 59644

( * ) Notice: Subject to any disclaimer, the term of this patent is extended or adjusted under 35 U.S.C. 154(b) by 0 days.

(21) Appl. No.: 09/839,021

(22) Filed: Apr. 21, 2001

(51) Int. Cl.[7] ..... B22F 3/10; B22F 9/04

(52) U.S. Cl. ..... 419/23; 419/33; 419/60; 75/357; 148/669; 148/513

(58) Field of Search ..... 75/357, 360; 148/513, 148/514, 669; 419/23, 33, 60

(56) References Cited

U.S. PATENT DOCUMENTS 3,758,669 A 9/1973 Potter et al.
4,470,847 A 9/1984 Hard et al.
4,838,935 A * 6/1989 Dunlop et al. ..... 419/60
4,839,085 A 6/1989 Sandrock et al.
4,923,513 A * 5/1990 Ducheyne et al. ..... 419/23
5,108,517 A * 4/1992 Kimura et al. ..... 148/669
5,143,560 A 9/1992 Doser

* cited by examiner

*Primary Examiner*—George Wyszomierski
(74) *Attorney, Agent, or Firm*—Mallinckrodt & Mallinckrodt; Robert R. Mallinckrodt

(57) ABSTRACT

A method of producing high purity, low oxygen content titanium powder utilizes a hydrided titanium powder crushed to desired percentage of particles of not more than a desired size. These hydrided particles are dehydrided by a slow heating process under partial vacuum to draw the hydrogen out of the particles with a minimum of sintering of the particles. The hydrided particles may be initially heated relatively rapidly, over a period of between about two hours and six hours to a temperature of between about 450° C. and 500° C. and then slowly over a period of four to five days to a temperature of between 650° C. and 700° C., all under a partial vacuum, until the hydrogen content of the powder reaches a desired value. The now dehydrided titanium powder is cooled, again crushed if and as necessary to break up any sintered particles, screened, and packaged. The method of the invention minimizes the sintering of the particles during the dehydriding process.

20 Claims, 1 Drawing Sheet

METHOD OF PRODUCING TITANIUM POWDER

BACKGROUND OF THE INVENTION

1. Field

Figure 1:
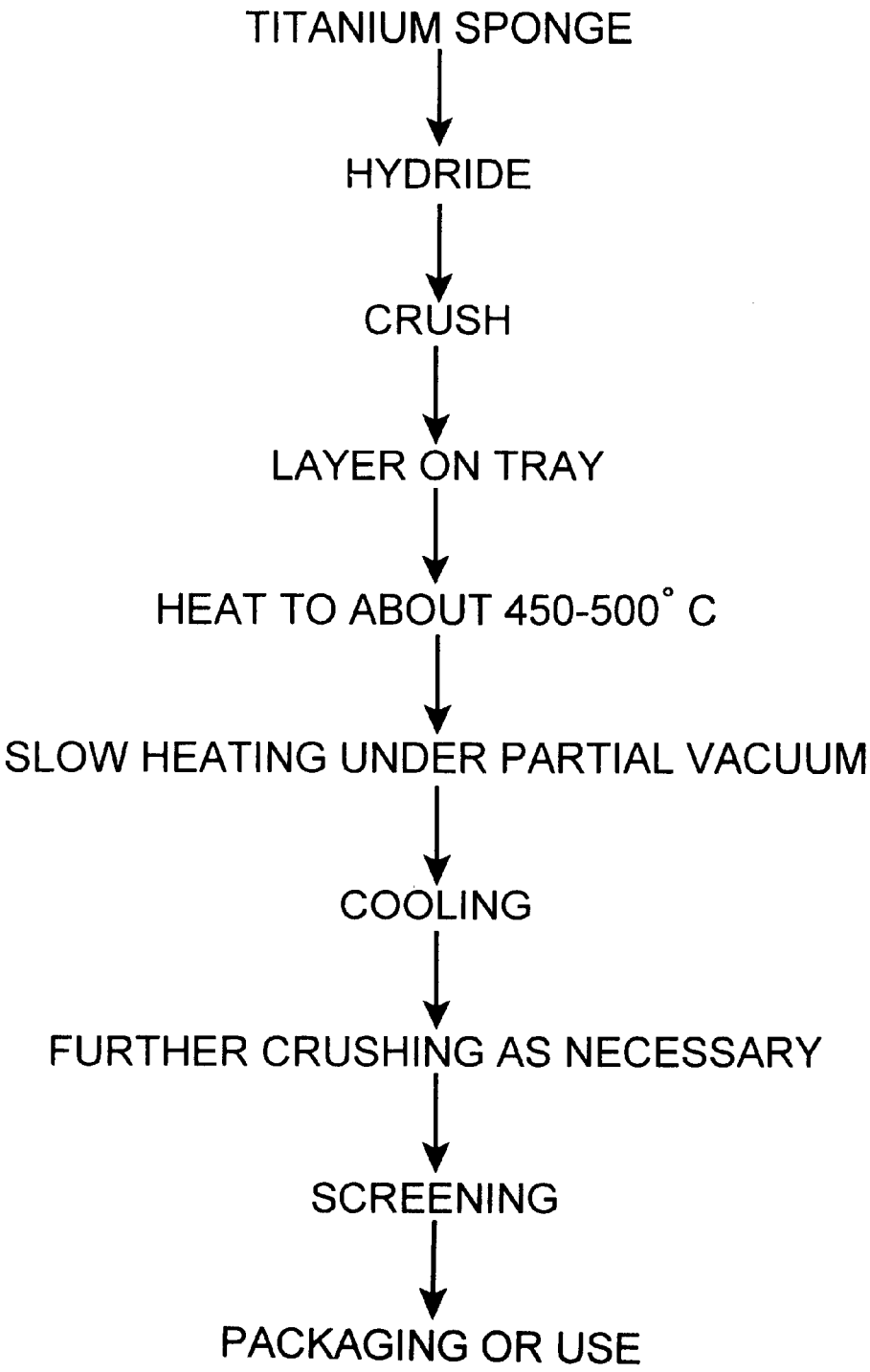

The invention is in the field of producing titanium powder.

2. State of the Art

There is a growing demand for high purity (99%), low oxygen content (less than 0.25%) titanium powder. Such powder, among other uses, may be used in metal injection molding processes where a metal powder is molded under pressure to about 95% density and is then fired at high temperatures in a reduced atmosphere to finish the product.

Hydriding and dehydriding processes are known. The hydriding of a metal to a metal hydride allows for production of fine powder. The metal hydride is generally much more frangible than the metal and can be more easily milled or otherwise crushed. After powdering, the hydride has to be dehydrided to provide a metal powder, particularly a high purity metal powder product. Generally the hydride powder is placed in a crucible and heated to a high temperature to cause dehydriding. With titanium, however, when heated to the high temperature, the powder tends to sinter into a mass which is no longer powder, and at elevated temperatures, the product reacts with oxygen. The oxidation is a problem with powder because of the large surface area of the powder particles. While high purity, low oxygen titanium powder is currently available, it is relatively expensive. The relatively high cost makes its use impractical for many products.

SUMMARY OF THE INVENTION

According to the invention, the sintering and oxidizing of a hydrided metal powder during dehydriding is reduced by arranging the powder for heating in a relatively thin layer of not greater than about one-quarter inch, slowly heating the powder during dehydriding over a period of several days, and providing a partial vacuum over the powder during heating. In accordance with the invention, a high purity, low oxygen content titanium powder is produced from a hydrided titanium powder by a dehydriding process where the powder is dehydrided in thin layers, one quarter inch or less thick, and the temperature is increased slowly as the hydrogen is released. The heating takes place in a reduced pressure atmosphere to draw out the hydrogen, and after dehydriding, upon cooling, the powder is kept in an inert atmosphere for any required further pulverization and packaging.

The process may start with a hydrided titanium powder of a desired percentage of particles less than a desired size. For a commercially desirable product useful for metal injection molding as well as other uses, it is desirable that the hydrided powder have about ninety percent or more of particles less than twenty-five microns in size with most particles in the ten to fifteen micron size range. This provides a powder of less than about 99.5% −325 mesh. This hydrided powder must be dehydrided. For dehydriding, the hydrided powder is spread on a tray in a relatively thin layer in the range of from one-eighth to one-quarter inch thick. The powder is heated to between about 450° C. and 500° C., usually relatively quickly over a period of about six hours. From there, heating continues slowly, under negative pressure (a partial vacuum) over a four to five day period until the powder reaches a temperature in the range of 650° C. to 700° C. This dehydrides the hydrided powder and will normally reduce the hydrogen content of the powder to less than 0.1% with minimal sintering of the powder. Faster temperature increases, particularly with increases to the final temperature range in four to five hours, generally results in substantial sintering of the powder, which is undesirable. Further, placing the powder in a crucible which generally results in a thickness of powder greater than one-quarter inch during heating also generally results in substantial sintering of the powder. The combination of the invention of the relatively thin layer of powder on a tray and slowly increasing the temperature over a period of several days, substantially reduces the sintering of the powder, however, some sintering still occurs.

The dehydrided powder is cooled, usually to about room temperature, maintaining the negative pressure atmosphere. As the vacuum is released, an inert atmosphere, such as an argon atmosphere, is introduced and maintained during further processing and packaging of the titanium powder. When cooled to around room temperature, the powder is transferred from the tray to a ball mill or hammer mill for further pulverization as needed to break up any sintered particles to maintain the desired particle size. The powder is then transferred to a glove box for screening to ensure a desired size specification, such as 99.5% −325 mesh, and is packaged in the inert atmosphere in polybags or polybottles and then in cans to maintain the inert atmosphere during shipping and storage of the powder.

The starting hydrided titanium powder is produced by hydriding titanium sponge and then crushing the hydrided titanium to the desired percentage of desired size particles by any desired method such as in a ball mill or hammer mill.

THE DRAWINGS

The best mode currently contemplated for carrying out the invention in practice is illustrated in the accompanying drawing in which:

FIG. 1 is a flow diagram of the method of the invention.

DETAILED DESCRIPTION OF THE ILLUSTRATED EMBODIMENT

The first step of the method of the invention is to obtain hydrided titanium powder of a desired percentage of a desired particle size. This can be done by purchasing the powder from a source of such powder, if available, or by making the powder. Titanium sponge is readily available in marble size pieces of −¾ +20 mesh. As indicated by the flow diagram of FIG. 1, the titanium sponge pieces are hydrided. This can be done by putting the pieces into a hydrogen atmosphere and heating them to about 750° C., usually over about a two hour period of time, using the well known Kroll process to form titanium hydride. Hydriding makes the titanium frangible so it can be crushed. The titanium hydride can be crushed and milled, such as with a ball mill or hammer mill, to form a desired powder. For producing a −325 mesh product, the hydrided titanium is preferably crushed to particle sizes in the range of from ten to twenty microns. This is the needed hydrided titanium powder.

The hydrided titanium powder then has to be dehydrided. According to the invention, the hydrided powder is layered onto a tray or other receiving surface which can be placed into an oven and withstand temperatures up to about 700° C. A stainless steel tray has been found satisfactory. The layers should be thin enough so that minimal weight or pressure is exerted onto the bottom portion of the layer. The preferred thickness of the layer is between about one-eighth and one-quarter inch.

The tray is placed into an oven and heated relatively rapidly, over a period of about two to six hours, to a temperature of between about 450° C. and 500° C. The hydrogen in the hydrided titanium begins to come out of the titanium at about 400° C. A negative pressure or partial vacuum is established over the hydrided titanium powder as it is heated to help draw off the hydrogen. Pressure in the range of 200 to 300 millitorr as heating begins which increases to about ten torr at 450° C. has been found to work well and is preferred. Additional heating is necessary, but additional heating is done relatively slowly and generally stepwise at a rate of between about 30° C. to about 50° C. every twenty-four hours until the titanium powder is heated to around 650° C. to 700° C. while still maintaining the partial vacuum over the titanium. The partial vacuum is maintained but initially decreases as the temperature increases from the initial 450° C. to 500° C. temperature as more hydrogen is pulled out of the titanium. The partial vacuum continues to help pull the hydrogen out of the hydrided titanium and will increase again as most of the hydrogen is released from the titanium. Initially, upon additional heating above the starting 450° C. to 500° C. temperature, the vacuum may drop to $10^{-2}$ torr or worse. As hydrogen is pulled from the powder, the vacuum increases again. Once at final temperature between about 650° C. and about 700° C., the vacuum may increase to between about $10^{-2}$ to $10^{-6}$ torr. Under these conditions, it has been found that the hydrogen content of the titanium powder can be reduced to less than 0.1%, with very little sintering of the powder.

Alternatively, the additional heating can be done in conjunction with keeping track of the vacuum over the titanium powder during heating. As the vacuum decreases at a particular temperature, the temperature is increased more slowly to keep the rate of hydrogen extraction from the titanium substantially constant. The hydrogen content of the powder is monitored and when below 0.1%, the dehydriding is complete and heating stops and cooling commences. This hydrogen content can be determined by the build up in vacuum. The 0.1% is an amount that is currently preferred for the product of the invention, but can vary depending upon the desired product. This alternate method will generally result in similar temperatures and heating times as the method just involving temperatures and time periods indicated above as such method is derived from a monitoring of the hydrogen release and is formulated to keep the hydrogen release relatively constant.

Once the hydrogen content of the powder has been reduced to the desired degree, the now dehydrided powder is cooled. A partial vacuum is maintained during cooling to about room temperature. When cooled to the desired temperature, the vacuum is released as an inert atmosphere, such as of argon gas, is introduced over the powder. The trays are pulled out of the furnace and the trays covered to maintain the inert atmosphere. The powder is transferred to a sealed container maintaining the inert atmosphere, such as a glove box or bag in which the now dehydrided powder can be further crushed or milled, if desired or necessary, as in a hammer or ball mill to break up any powder particles that have been sintered together to ensure the desired concentration of desired sized particles. The advantage of the process of the invention is that very little sintering of the particles actually takes place. However, all sintering cannot be eliminated without taking much more time to dehydride the powder than is economically feasible. For example, most sintering could be eliminated by limiting the dehydriding temperature to about 500° C. However, dehydriding would take several weeks or more at the 500° C. The additional milling or crushing is performed and, if not performed in a glove box, the powder is then transferred, still under inert atmosphere, to a glove box where it can be screened to ensure the desired concentration of desired particle size, and is then packaged such as in polybottles or bags, and cans, all under the inert atmosphere and in such manner to ensure that such inert atmosphere remains to reduce the oxygen exposure to the powder. The powder, without further crushing, can merely be screened in the glove box or similar apparatus to maintain the inert atmosphere, to generate the desired sized powder and that powder packaged. The screened out larger particles can be recycled in the process or otherwise disposed of Depending upon the desired final powder product and its intended use, the dehydrided powder may not need to be screened and in such cases can be packaged without further crushing and/or screening. The powder is shipped as packaged in the inert atmosphere in such containers to a user.

In a preferred example of the process of the invention, titanium sponge is loaded into a crucible. The loaded crucible is put into a retort furnace and the cover is secured onto the retort furnace. The furnace is evacuated to $<1\times10^{-3}$ Torr and the titanium is heated to 750° C. over about a two hour period. The vacuum in the furnace is isolated and the furnace backfilled with hydrogen to provide a hydrogen atmosphere over the titanium. The titanium is held at the 750° C. temperature under a positive pressure hydrogen atmosphere for about six hours to produce hydrided titanium. The reaction that takes place is $Ti+2H\rightarrow TiH_2$. The heat is shut off and the titanium is cooled under the hydrogen atmosphere to room temperature. The hydrogen is evacuated from the furnace and the furnace is backfilled with air. The cover is removed from the furnace and the crucible with hydrided titanium is removed and the hydrided titanium is unloaded from the crucible. The hydrided titanium is crushed to <20 mesh. It is then milled for four to six hours and screened to obtain the desired hydrided titanium powder.

The sized hydrided titanium powder is loaded in layers onto furnace trays. The trays are sized so that about five pounds of titanium powder can be loaded onto a tray in a layer no more than one-quarter inch thick. The trays are loaded into a carrier and loaded into the retort furnace. The cover is secured on the furnace and the furnace evacuated to $<0.5\times10^{-3}$ Torr. The furnace then heats the titanium powder to about 500° C. over about a six hour time period. Vacuum is maintained in the furnace and the temperature is increased by 500° C. every twenty four hours until the titanium powder is heated to 650° C. With the temperature at 650° C., the vacuum is monitored and after about twenty four hours, the vacuum should be $<1\times10^{-3}$ Torr. At this point, the titanium powder has been dehydrided to a hydrogen content of less than 0.1%. The reaction that takes place is $TiH_2\rightarrow Ti+2H$. The furnace is shut down and cooled to room temperature, while maintaining the vacuum in the furnace. At room temperature, the vacuum is released and the furnace backfilled with argon gas to create an inert atmosphere for the titanium powder. The cover is removed from the furnace and the trays removed. The titanium is removed from the trays. The titanium powder is then screened to the desired size. If necessary, the titanium can be crushed or milled after removal from the furnace to crush any sintered particles that need recrushing. After screening for sizing, the titanium powder is packaged for storage and shipping. All steps after removal from the furnace are done under the argon or other inert atmosphere to reduce oxidation of the powder and may be done in a glove box. The titanium powder produced is of high purity, minimum 99% pure, low oxygen content, maximum 0.25%, low hydrogen content, maximum 0.1%, and 99.5% −325 mesh.

While particular sizes and oxygen and hydrogen content are referred to in the description and example, such are for a high purity, low oxygen content titanium powder with specific specifications. The sizes, hydrogen content and other parameters indicated can vary depending upon the use to be made of the powder, and specifications for a high purity and low oxygen content titanium powder can vary widely.

Whereas this invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

What is claimed is:

1. A method of producing high purity, low oxygen content titanium powder, comprising the steps of obtaining crushed hydrided titanium powder with a desired percentage of particles of not more than a desired particle size;

loading the crushed hydrided titanium powder as a layer onto a tray;

heating the crushed hydrided titanium powder to between about 450° C. and about 500° C.;

further heating the crushed hydrided titanium powder slowly over a period of between about four and five days under a partial vacuum to a temperature of between about 650°C. and about 700° C. to thereby dehydride the titanium powder;

cooling the now dehydrided titanium powder still under the partial vacuum;

placing the titanium powder under an inert atmosphere; and packaging the titanium powder in the inert atmosphere.

2. A method of producing high purity, low oxygen content titanium powder according to claim 1, wherein the layer on the tray is between about one-eighth and about one-quarter inch thick.

3. A method of producing high purity, low oxygen content titanium powder according to claim 2, wherein the tray is a stainless steel tray.

4. A method of producing high purity, low oxygen content titanium powder according to claim 3, wherein the inert atmosphere is an argon atmosphere.

5. A method of producing high purity, low oxygen content titanium powder according to claim 4, wherein the vacuum varies between about 100 millitorr and about 10 Torr.

6. A method of producing high purity, low oxygen content titanium powder according to claim 5, wherein the desired particle size of the hydrided titanium powder is less than about fifteen microns.

7. A method of producing high purity, low oxygen content titanium powder according to claim 6, wherein the desired percentage is about 0.1 to about 0.25%.

8. A method of producing high purity, low oxygen content titanium powder according to claim 5, wherein the desired particle size of the hydrided titanium powder is −325 mesh.

9. A method of producing high purity, low oxygen content titanium powder according to claim 1, wherein the further heating takes place in steps.

10. A method of producing high purity, low oxygen content titanium powder according to claim 9, wherein the temperature is increased in a step of no more than about 25° C. every twenty four hours.

11. A method of producing high purity, low oxygen content titanium powder according to claim 1, further including the step of screening the cooled titanium powder in the inert atmosphere to separate desired size particles for packaging.

12. A method of producing high purity, low oxygen content titanium powder according to claim 11, including the additional step of crushing the cooled titanium powder in the inert atmosphere to break up any sintered particles that have formed during heating to maintain the desired percentage of particles not more than the desired size.

13. A method of producing high purity, low oxygen content titanium powder according to claim 12, wherein the steps of further crushing, screening, and packaging take place in a glove box.

14. A method of producing high purity, low oxygen content titanium powder according to claim 1, wherein the inert atmosphere is an argon atmosphere.

15. A method of producing high purity, low oxygen content titanium powder according to claim 1, wherein the step of obtaining crushed hydrided titanium powder includes the additional steps of:

hydriding titanium sponge; and crushing the hydrided titanium sponge to produce the desired percentage of particles of not more than the desired particle size.

16. A method of producing high purity, low oxygen content titanium powder, comprising the steps of:

obtaining crushed hydrided titanium powder with a desired percentage of particles of not more than desired particle size;

loading the crushed hydrided titanium powder as a layer onto a tray;

heating the crushed hydrided titanium powder to between about 450°C. and about 500° C.;

further heating the crushed hydrided titanium powder slowly over a period of between about four and five days in an inert atmosphere and under vacuum while monitoring the rate of hydrogen release from the crushed hydrided titanium, the heat being increased as needed to maintain a substantially constant release of hydrogen in a desired range until the hydrogen content of the crushed titanium is less than a desired percentage resulting in dehydrided titanium powder;

cooling the now dehydrided titanium powder in the inert atmosphere; and packaging the titanium powder in an inert atmosphere.

17. A method of producing high purity, low oxygen content titanium powder according to claim 16, including the additional step of screening the cooled titanium powder in the inert atmosphere to separate desired size particles for packaging.

18. A method of producing high purity, low oxygen content titanium powder according to claim 17, including the additional step of crushing the cooled titanium powder in the inert atmosphere to break up any sintered particles that have formed during heating to maintain the desired percentage of particles not more than the desired size.

19. A method of producing high purity, low oxygen content titanium powder according to claim 16, wherein the rate of hydrogen release is monitored by monitoring the vacuum over the titanium powder as it is further heated.

20. A method of reducing the sintering of titanium powder particles during dehydriding of hydrided titanium powder, comprising the steps of:

arranging the powder in a layer for heating;

slowly heating the layer of powder from between about 450°C. and about 500° C. to between about 650° C. and about 700° C. over a period of time greater than three days; and maintaining a partial vacuum over the powder during heating to help draw the hydrogen out of the powder.

* * * * *